US006138594A

United States Patent [19]

Kito

[11] Patent Number: 6,138,594

[45] Date of Patent: Oct. 31, 2000

[54] ELECTRONICALLY CONTROLLED SEWING MACHINE

[75] Inventor: Kiyoshige Kito, Nagoya, Japan

[73] Assignee: Brother Kogyo Kabushiki Kaisha, Nagoya, Japan

[21] Appl. No.: 09/250,269

[22] Filed: Feb. 16, 1999

[30] Foreign Application Priority Data

Feb. 23, 1998 [JP] Japan ..... 10-058925

[51] Int. Cl.[7] ..... D05B 19/00; G08B 21/18

[52] U.S. Cl. ..... 112/470.01; 112/277; 112/279; 112/445

[58] Field of Search ..... 112/277, 275, 112/470.01, 220, 445, 235, 237, 239, 279

[56] References Cited

U.S. PATENT DOCUMENTS

| | | | |
|---|---|---|---|
| 4,393,796 | 7/1983 | Dunn et al. . | |
| 4,481,507 | 11/1984 | Takiguchi et al. | 112/277 X |
| 4,598,657 | 7/1986 | Makabe et al. . | |
| 5,078,067 | 1/1992 | Nakashima | 112/277 X |
| 5,092,257 | 3/1992 | Ogawa | 112/225 |
| 5,265,026 | 11/1993 | Nishizawa et al. | 112/277 X |
| 5,778,810 | 7/1998 | Akahane et al. | 112/470.01 |
| 5,899,157 | 5/1999 | Kurono et al. | 112/470.01 |

FOREIGN PATENT DOCUMENTS

| | | |
|---|---|---|
| 54-116440 U | 8/1979 | Japan . |
| 57-137907 | 8/1982 | Japan . |
| B2-1-42705 | 9/1989 | Japan . |

*Primary Examiner*—Peter Nerbun
*Attorney, Agent, or Firm*—Oliff & Berridge, PLC

[57] ABSTRACT

An electronically controlled sewing machine indicates which of the basic operations for the machine is possible or impossible in a readily identifiable manner to a user, thereby improving the ease of operation of the machine. A start/stop button is illuminated with steady green light, that is, a first illuminated state, when a presser foot is at a pressing position and a needle bar is within a threading possible range. When the presser foot is at a withdrawn position and the needle bar is within the threading possible range, the start/stop button is illuminated with red flicker, that is, a second illuminated state. When the presser foot is at the pressing position and the needle bar is out of the threading possible range, the start/stop button is illuminated with green flicker, that is, a third illuminated state. When the presser foot is at the withdrawn position and the needle bar is out of the threading possible range, the start/stop button is illuminated with steady red light, that is, a fourth illuminated state. The indications by the different illuminated states make it easy for the operator to recognize which of the basic operations, including needle thread placement, needle threading, and so on, is possible or impossible. Alternatively, the indications can be provided by sound signals or messages presented on a display.

22 Claims, 7 Drawing Sheets

Fig.7

| | 1ST STATE | 2ND STATE | 3RD STATE | 4TH STATE |
|---|---|---|---|---|
| BUZZER SOUND | SILENT | PI, PI, PI, . . . | PIPI, PIPI, PIPI, . . . | PI——— |

ELECTRONICALLY CONTROLLED SEWING MACHINE

BACKGROUND OF THE INVENTION

1. Field of the Invention

The invention relates to an electronically controlled sewing machine and, more particularly, to a technology that makes it possible, by using an informing device, to know which of various basic operations of the sewing machine, including the threading through a needle and the setting of a work cloth to a sewing position, is possible or impossible.

2. Description of the Related Art

Conventional home-use electronically controlled sewing machines provide various practical patterns, such as straight stitching and zigzag stitching; various character patterns, such as Japanese phonetic characters, that is, "hiragana" and "katakana", and Roman letters; and various embroidery patterns including symbols, marks, and images, which are pre-stored in a pattern data memory provided in a ROM (non-volatile memory) of a control unit. A desired pattern or embroidery pattern can be found and selected by a user displaying patterns on a display panel and switching display screens. After selecting a desired pattern, the user simply operates a start switch, so that the sewing machine motor is immediately driven to form the selected pattern in a work cloth.

However, an inexperienced user who has just bought an electronically controlled sewing machine may well be unfamiliar with the names of parts, such as "presser foot" and "thread take-up lever", and also unfamiliar with various basic operations involved in using a sewing machine, such as the needle thread placement, bobbin thread preparation, and bobbin replacement. A latest-model electronically controlled sewing machine is equipped with many functions, so that the handling of the machine is complicated. Therefore, when a user who has just bought an electronically controlled sewing machine actually performs an action such as needle thread placement or bobbin thread preparation, the user needs to frequently refer to the instruction manual to follow the described procedures step by step and thereby manage to place the needle thread at designated positions, to wind a thread around a bobbin, set the bobbin in a bobbin case, and mount it in the shuttle body.

After the needle thread and the bobbin thread have been made ready, a desired stitching pattern must be selected. Actual stitching will be started only after the user performs further operations, for example, raises the presser foot, inserts a work cloth between the presser foot and the needle plate, lowers the presser foot onto the work cloth, and then operates the stitching start switch. To perform these operations, too, the user may well have to keep the instruction manual nearby and to refer to the described procedures step by step.

As stated above, a user unfamiliar with the names of the parts of a sewing machine and the basic operations to use the machine is often uncertain whether, for example, it is possible to place a needle thread at the designated positions or to pass the needle thread through the needle eye, with the needle bar and the thread take-up lever being at the present positions, or whether it is possible to replace the bobbin shuttle. However, the sewing machine itself does not indicate or display any information regarding whether it is possible to perform a basic operation as mentioned above. As a result, the user may possibly look at the instruction manual again and again and/or perform the operations by trial and error. Moreover, knowing that the sewing machine is "electronically controlled" may add to the inexperienced user's uncertainty about things that the user sees or performs.

SUMMARY OF THE INVENTION

Accordingly, it is an object of the invention to provide an electronically controlled sewing machine that visually or aurally informs a user which of the basic operations of the sewing machine is possible or impossible, thereby improving the ease of operation, particularly, for inexperienced users.

In accordance with the invention, an electronically controlled sewing machine includes a needle bar holding a needle at a lower end portion of the needle bar, a needle bar drive mechanism that drives the needle bar at least in up-down directions, a detection device that detects a position of the needle bar, and an informing device that receives a detection signal from the detection device and informs the user, in an identifiable manner, whether the position of the needle is within a predetermined position range above a needle plate.

When the position of the needle bar is detected by the detection device, the informing device, receiving the detection signal from the detection device, informs the user whether the position of the needle or the needle bar is within the predetermined position range above the needle plate, in an identifiable manner using, for example, different color illuminations or sound. These identifiable indications make it easy for the user to realize whether the position of the needle is within the predetermined range above the needle plate. That is, the user is informed of which of the basic operations in the sewing machine, including the passing of a needle thread through the thread take-up lever and/or the needle eye, and the replacement of a shuttle bobbin, is possible or impossible.

In the electronically controlled sewing machine of the invention, the predetermined position range of the needle may be a range in which at least one of needle threading, work cloth setting, and bobbin replacement is possible.

Therefore, even if the predetermined position range of the needle is narrow, at least one of the needle threading, the work cloth setting and the bobbin replacement becomes possible simply by manually moving the needle bar so that the informing device informs or indicates to the user the needle is within the predetermined position range, in a manner specific to the situation.

The informing device may use a plurality of light-emitting diodes that emit different color lights for identifiable indications.

The informing device indicates whether the needle is within the predetermined position range in an identifiable manner using different color lights emitted by the light-emitting diodes. Therefore, based on the color illumination, the user can easily realize whether the needle is within the predetermined position range.

The informing device may be incorporated into a switch button for operating a stitching start switch that outputs a stitching start instruction.

Normally, the switch button for operating the stitching start switch to output the stitching start instruction is disposed at a position such that the button is easy to operate and easy to see. Therefore, incorporated into the switch button, the informing device can effectively inform the user of the position of the needle.

The informing device may be provided near a switch button for operating a stitching start switch that outputs a stitching start instruction.

Because the switch button for operating the stitching start switch so as to output the stitching start instruction is normally disposed at such a position that the button is easy to operate and easy to see, the informing device, disposed near the switch button, can effectively inform the user of the position of the needle.

The informing device may change at least one of a sound length and a sound pitch for identifiable indications.

Therefore, the informing device informs the user whether the needle is within the predetermined position range, in an identifiable manner by changing sound length or pitch, so that based on the sound indication, the user can easily realize whether the needle is within the predetermined position range.

The electronically controlled sewing machine of the invention may further include a stitching permitting device that cooperates with the informing device and permits stitching to be started if stitching is possible.

The stitching permitting device, cooperating with the informing device, permits stitching to be started, if the needle is within the predetermined position range and operations such as thread placement, needle threading, and bobbin replacement, have been performed so that stitching is possible.

BRIEF DESCRIPTION OF THE DRAWINGS

A preferred embodiment of the invention will be described in detail with reference to the following Figures wherein:

FIG. 7 exemplifies buzzer sound indications of different vertical positions of the needle bar.

DETAILED DESCRIPTION OF PREFERRED EMBODIMENTS

Preferred embodiments of the invention will be described hereinafter with reference to the accompanying drawings.

In the embodiments, the invention is applied to an electronically controlled embroidery-type sewing machine that is equipped with an embroidering device and is capable of forming various embroidery patterns.

Figure 1:
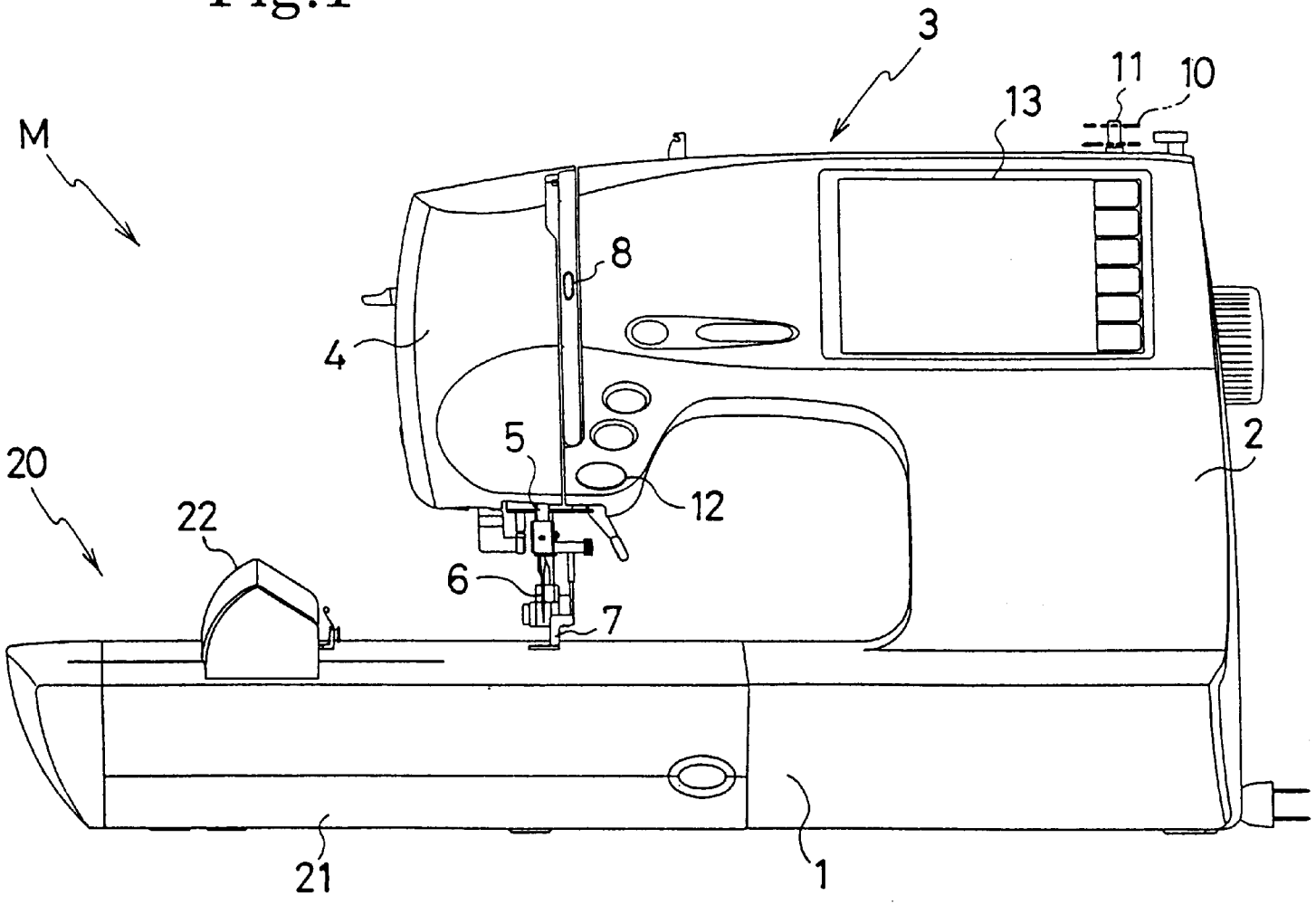
FIG. 1 is a front elevation of an electronically controlled sewing machine according to a preferred embodiment of the invention.

Referring to FIG. 1, an electronically controlled embroidering machine M has a machine bed 1, a column 2 standing from a right-side end portion of the bed 1, and an arm 3 extending from an upper end portion of the column 2 leftwards and facing the bed 1.

The bed 1 houses various mechanisms, such as a feed dog up-down movement mechanism (not shown) for moving a feed dog up and down, a feed dog back-forth movement mechanism (not shown) for moving the feed dog back and forth, and a loop capturing device (for example, a vertical axis rotating hook or shuttle) that houses a shuttle bobbin and cooperates with the needle 6.

The arm 3 houses, at least, a needle bar up-down drive mechanism (not shown) for moving a needle bar 5 up and down together with the needle 6 connected to a lower end portion of the needle bar 5, a needle bar oscillating mechanism (not shown) for oscillating the needle bar 5 in directions perpendicular to the cloth feeding directions, a presser mechanism for moving a presser foot 7 via a presser bar between a pressing lower position and a withdrawn upper position in accordance with the operation of a presser lever (not shown), a thread take-up lever drive mechanism (not shown) for moving a thread take-up lever 8 up and down synchronously with the up-down movements of the needle bar 5, and a bobbin winding mechanism for winding a thread on a bobbin 10. The needle bar up-down drive mechanism and the needle bar oscillating mechanism correspond to a needle bar drive mechanism.

A bobbin winder spindle 11 of the bobbin winding mechanism is projected upward from the arm 3, for detachably supporting the bobbin 10. A thread can be wound on the bobbin 10 set on the bobbin winder spindle 11 without rotating a machine main shaft, by sliding the bobbin winder spindle 11 together with the bobbin 10 laterally to a predetermined winding position, and then operating a start/stop button 12. The feed dog up-down movement mechanism, the needle bar up-down drive mechanism and the thread take-up lever drive mechanism are driven by a machine motor 44. The needle bar oscillating mechanism is driven by a needle bar oscillating stepping motor 45, and the feed dog back-forth movement mechanism is driven by a feed dog stepping motor 46 (see FIG. 2).

A head portion 4 of the arm 3 is provided with the start/stop button 12 for operating a start/stop switch 12*a* for instructing start and stop of a stitching operation. The start/stop button 12 is disposed at such a position that the start/stop button 12 is easy to see and to operate. The start/stop button 12 has a built-in color light-emitting diode (LED) device 48 made up of at least two light-emitting diodes, that is, a red light-emitting diode and a green light-emitting diode. Therefore, when the red light-emitting diode is driven, the start/stop button 12 is illuminated with red light. When the green light-emitting diode is driven, the start/stop button 12 is illuminated with green light. When the red and green light-emitting diodes are driven, the start/stop button 12 is illuminated with orange light.

A large-size liquid crystal display 13 is provided on a front face of the arm 3, for displaying various stitching patterns including saving stitch patterns, embroidery patterns, and messages. The liquid crystal display 13 carries on its front face a touch panel 14 that functions as touch keys. The touch panel 14 has band-like vertical and horizontal transparent electrodes at positions corresponding to, for example, the display positions of various embroidery patterns and function names indicating various functions. Therefore, a desired embroidery pattern or a desired function can be selected or instructed by pressing a touch key 14 corresponding to the embroidery pattern or the name of the function.

A left-side end portion of the bed 1 is formed as a free bed portion generally termed a free arm. The free bed portion removably supports an embroidering device 20.

The embroidering device 20 has a body case 21, an embroidery frame (not shown) for removably holding a work cloth, and a housing case 22 housing a Y-axis drive mechanism for moving the embroidery frame in the directions of a Y-axis (forward and backward). An X-axis drive mechanism is housed in the body case 21 for moving the housing case 22 together with the Y-axis drive mechanism disposed therein in the directions of the X-axis (rightward and leftward). The X-axis drive mechanism is driven by an X-axis drive motor 23, and the Y-axis drive mechanism is driven by a Y-axis drive motor 24 (see FIG. 2).

When the embroidering device 20 is mounted on the free bed portion, the X-axis and Y-axis drive motors 23, 24 become electrically connected to a control unit 30 of the electronically controlled embroidering machine M via a connector 37, so that the connected state of the embroidering device 20 is detected. Thus, an embroidery ready state is set where the control unit 30 can drive and control the drive motors 23, 24 so as to move the embroidery frame together with the work cloth in the X-directions and Y-directions independently from each other while performing an embroidery stitching operation.

The control system of the electronically controlled embroidering machine M will next be described.

Figure 2:
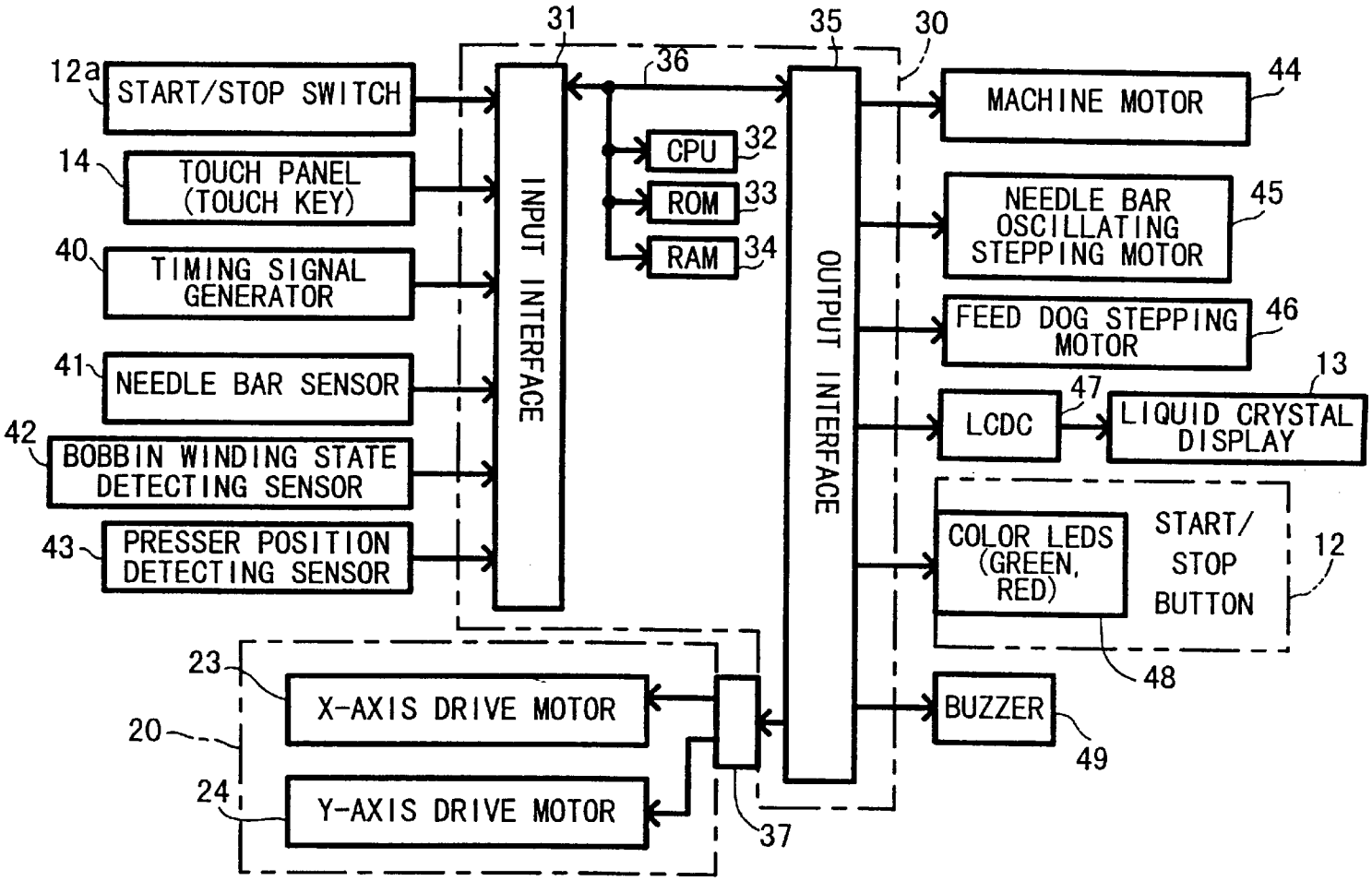
FIG. 2 is a block diagram of a control system of the electronically controlled sewing machine.

Referring to FIG. 2, the control unit 30 has an input interface 31, and a control portion including a CPU 32, a ROM 33 and a RAM 34, and an output interface 35, and a bus 36 connecting these components. The input interface 31 is connected to the start/stop switch 12*a*, the touch panel (touch keys) 14, a timing signal generator 40 for detecting a plurality of rotation phases of the machine main shaft, a needle bar sensor 41, a bobbin winding state detecting sensor 42, and a presser position detecting sensor 43.

Figure 3:
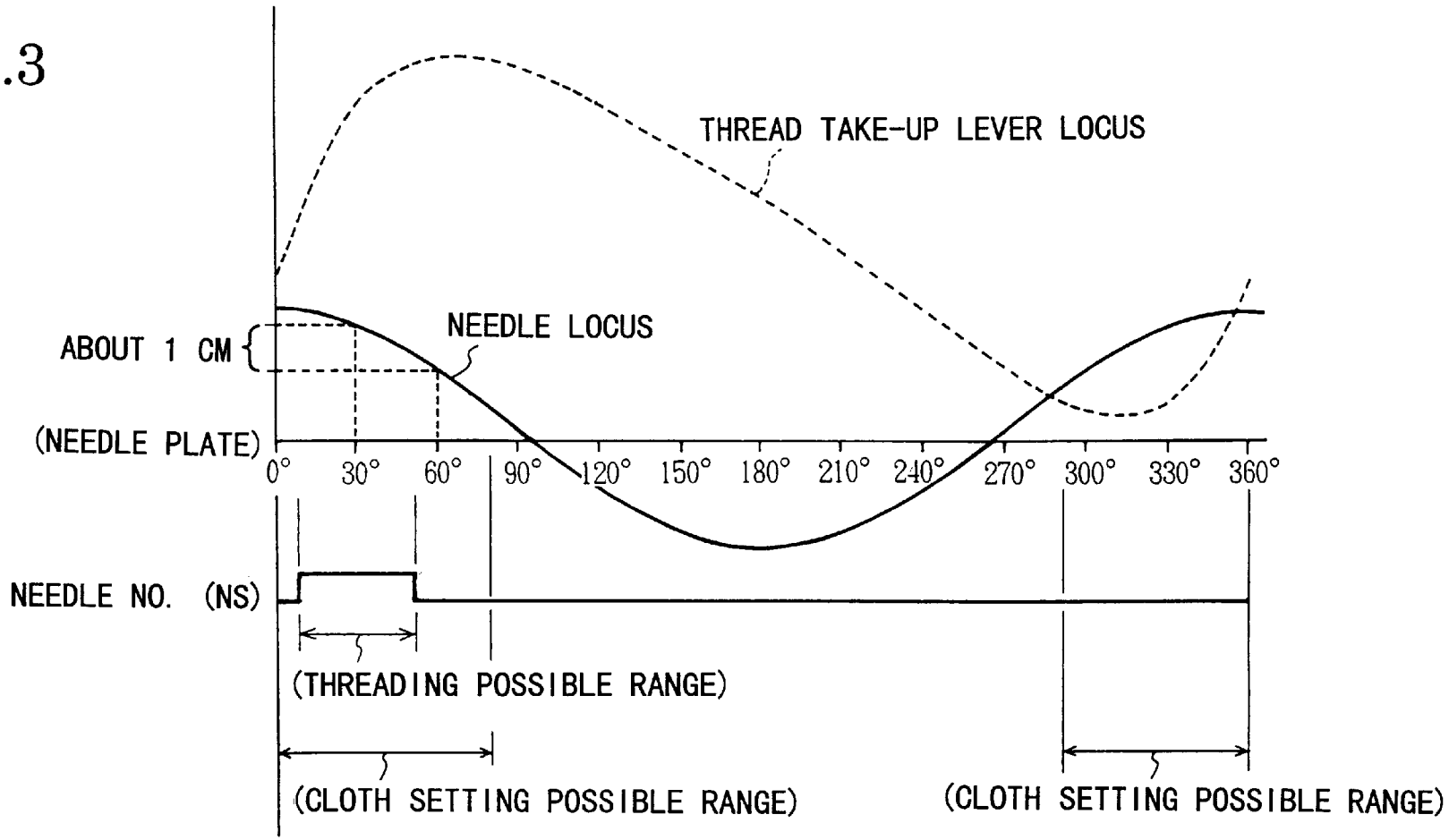
FIG. 3 is a timing chart illustrating various operation ranges along the loci of a needle bar and a thread take-up lever.

The needle bar sensor 41 is an optical sensor made up, for example, of a photo-interrupter, light source and light detector. The needle bar sensor 41 is disposed so as to face a sector-shaped blocking plate (not shown) mounted on the machine main shaft. When detection light is blocked by the blocking plate (photo-interrupter), that is, when the needle bar 5 is within a threading possible range (corresponding to a predetermined range of the needle bar 5) of about 10° to about 50° in phase angle as indicated in FIG. 3, with the uppermost position of the needle bar 5 being defined as 0°, the needle bar sensor 41 outputs a high-level needle bar signal NS. The threading possible range is a narrow range (corresponding to, for example, about 1 cm in a vertical direction) extending from a position slightly below the uppermost position of the needle bar 5 to a position at which the eye of the needle 6 is appropriately above the needle plate of the bed 1, that is, a position range where the thread take-up lever 8 protrudes forward of the arm 3 and a thread can be most easily passed through the needle eye.

The bobbin winding state detecting sensor 42 is provided so as to cooperate with the bobbin winder spindle 11. When the bobbin winder spindle 11 is slid to the predetermined winding position, the bobbin winding state detecting sensor 42 outputs a winding state detection signal. The presser position detecting sensor 43 cooperates with the presser bar. When the presser foot 7 is moved to the predetermined withdrawn position above the needle plate, the presser position detecting sensor 43 outputs a detection signal indicating the ascent of the presser foot 7.

The output interface 35 is connected to, at least, the machine motor 44, the needle bar oscillating stepping motor 45, the feed dog stepping motor 46, a liquid crystal display controller (LCDC) 47 for the liquid crystal display 13, the color LED device 48 incorporated in the start/stop button 12, a buzzer 49, and the connector 37 connected to the X-axis drive motor 23 and the Y-axis drive motor 24 of the embroidering device 20.

The ROM 33 stores pattern selection control programs for selecting practical (standard sewing) stitches and various embroidery patterns; general control programs for display control or drive control for driving the various motors 44–46, 23, 24 in order to stitch a selected stitch or embroidery pattern; an edit control program for editing a selected embroidery pattern on the liquid crystal display 13, for example, setting a size of the pattern or changing a stitching position; and control programs for stitch control according to the invention (described below). Also stored in the ROM 33 are various pattern data, including display data and stitch data, with regard to a plurality of stitch patterns, character patterns, and embroidery patterns. The pattern data in the ROM 33 are grouped according to the types of patterns and assigned with pattern numbers.

The RAM 34 is provided with memories (including flag, pointer, counter, register, and buffer memories) needed for the aforementioned controls.

Figure 4:
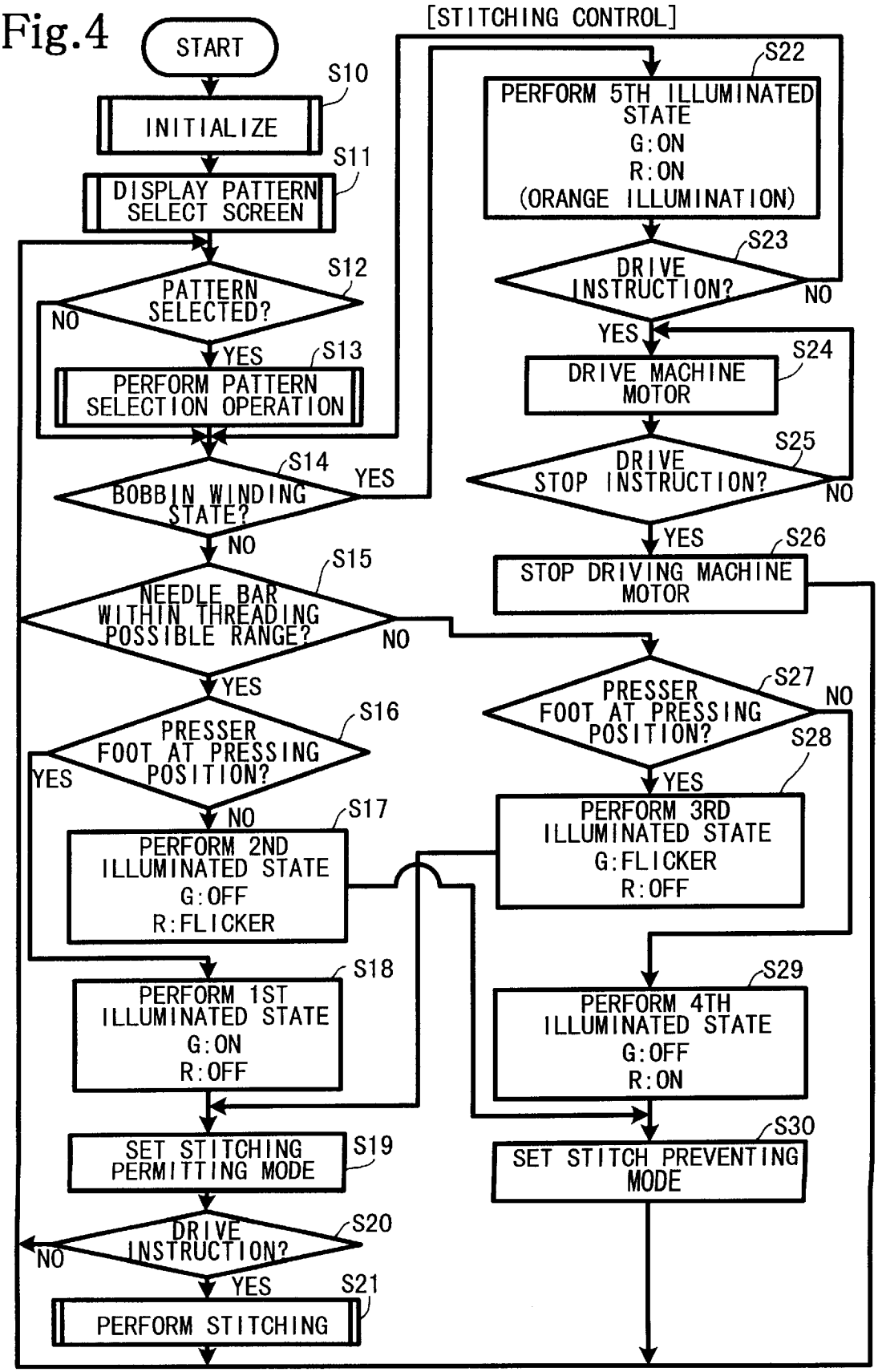
FIG. 4 is a flowchart illustrating a stitching control routine.

The stitching control routine executed by the control unit 30 will be described with reference to the flowchart of FIG. 4.

When the embroidering machine M is powered on so that the stitching control routine is started, the control unit 30 performs initialization in step S10, for example, the memories of the RAM 34 are cleared. Subsequently in step S11, a pattern selecting screen is displayed. In step S12, the operator indicates, using the touch panel 14, that he/she wants to select by operating an appropriate touch key on the touch panel 14. If the determination is affirmative (YES in step S12), the control unit 30 performs a pattern select operation in step S13.

Figure 5:
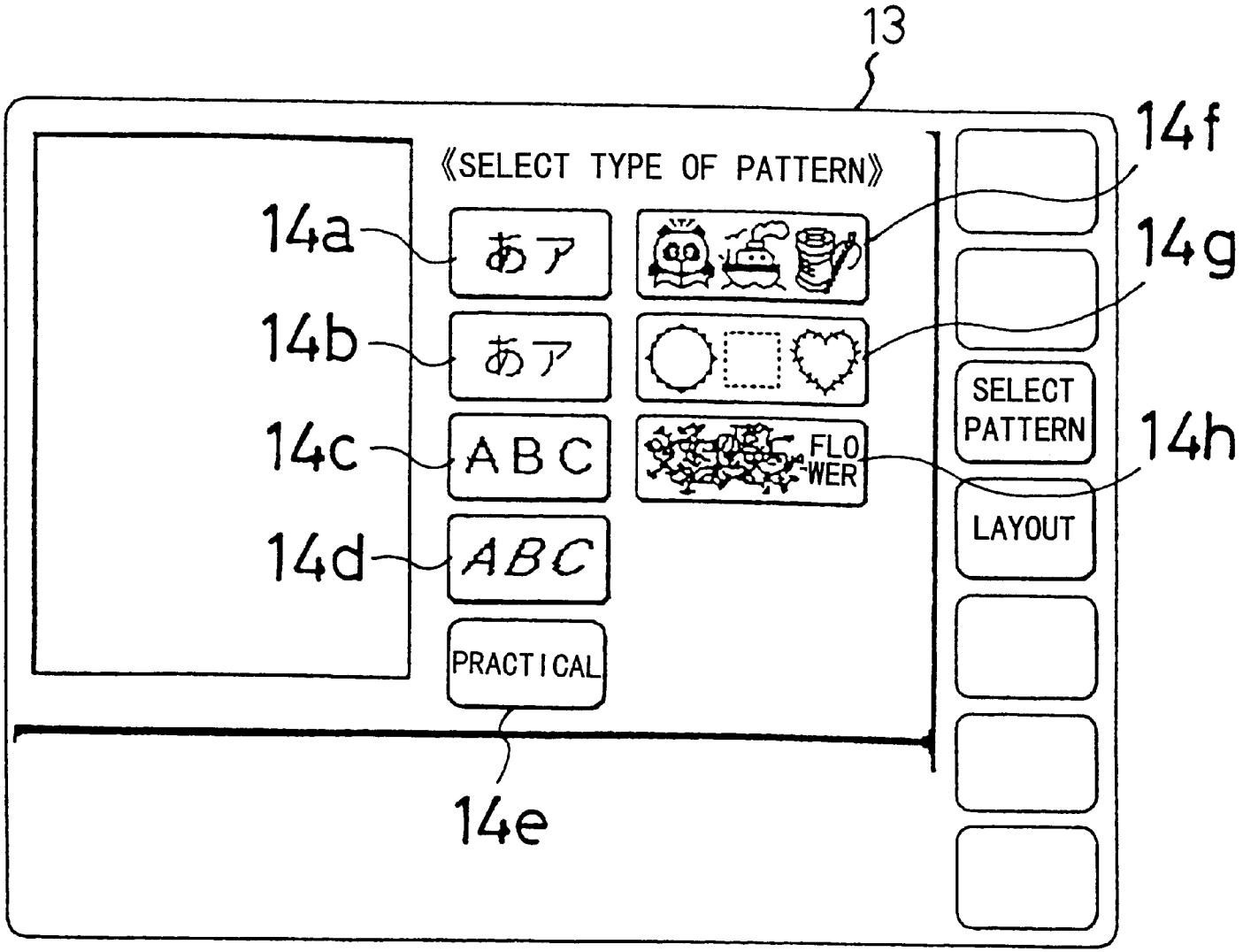
FIG. 5 illustrates an initial screen for pattern selection.

FIG. 5 shows an example of the pattern selecting screen on the liquid crystal display 13, where two styles of each Japanese character and ABC for selecting character patterns, PRACTICAL for selecting practical patterns, various embroidery symbols and pictures of a panda, figures, flowers, etc. are displayed in separate boxes 14*a* through 14*h*, for selecting embroidery patterns, respectively. The separate boxes 14*a* through 14*h* act as pattern select keys because the screen of the liquid crystal display 13 is formed of touch panel switches as described previously. Therefore, a user can select a desired pattern by touching the corresponding one of separate boxes 14*a* through 14*h*.

In step S14, it is determined whether the bobbin winding state has been established, on the basis of the detection signal from the bobbin winding state detecting sensor 42. If the determination in step S14 is affirmative (Yes), the operation jumps to step S22, in which the control unit 30 causes the color LED device 48 to produce orange light, that is, a fifth illuminated state of the start/stop button 12, by simultaneously driving the green light-emitting diode and the red light-emitting diode of the color LED device 48.

The start/stop button 12, disposed at an easy-to-see position, is illuminated with orange color light, so that the user readily recognizes that the bobbin winding state has been established.

Subsequently in step S23, it is determined whether a drive instruction is inputted to start the machine motor 44 by the user operating the start/stop button 12. If the determination in step S23 is affirmative (Yes), the operation proceeds to step S24, in which the control unit 30 drives the machine motor 44 to wind a bobbin thread on the bobbin 10. Subsequently in step S25, it is determined whether a drive stop instruction is inputted by the user operating the start/stop button 12 when the bobbin winding has been completed. If the determination in step S25 is affirmative (Yes), the control unit 30 stops driving the machine motor 44 in step S26.

If it is determined in step S14 that the bobbin winding state has not been established (NO in step S14), the operation proceeds to step S15, in which it is determined whether the needle bar signal NS is at the high level, that is, whether the needle bar 5 is within the threading possible range. If the determination in step S15 is affirmative (Yes), it is determined in step S16 whether the presser foot 7 is at the pressing position on the basis of the detection signal from the presser position detecting sensor 43. If the determination in step S16 is affirmative (Yes), the operation proceeds to step S18, in which the control unit 30 causes the start/stop button 12 to be illuminated with steady green light, that is, a first illuminated state, by driving the green light-emitting diode but not driving the red light-emitting diode. Subsequently in step S19, a stitching permitting mode is set.

That is, the start/stop button 12 is illuminated with steady green light when the needle bar 5 is within the threading possible range and the presser foot 7 is at the pressing position. Therefore, by the green illumination of the start/stop button 12, the user readily realizes that it is possible to pass a thread through the eye of the needle 6 and to perform stitching while it is not possible to set or remove a work cloth or to replace the shuttle bobbin. After the user sets a work cloth and checks that the needle thread placement and the bobbin thread preparation have been done, the user operates the start/stop button 12 to input the drive instruction. Then, in step S20, the control unit 30 determines that the drive instruction is inputted (YES in step S20). Subsequently in step S21, the control unit 30 performs the stitching operation based on the stitch data of the pattern selected by the user.

If the needle bar 5 is within the threading possible range (YES in step S15) but the presser foot 7 is at the withdrawn position (NO in step S16), the control unit 30 causes the start/stop button 12 to be illuminated with flickering red light, that is, a second illuminated state, in step S17, by driving the red light-emitting diode in a flickering manner while maintaining the non-driven state of the green light-emitting diode. Subsequently in step S30, a stitching preventing mode is set, so that the drive instruction from the start/stop switch 12*a* is rejected.

That is, the start/stop button 12 is illuminated with flickering red light when the needle bar 5 is within the threading possible range and the presser foot 7 is at the withdrawn position. Therefore, by the red flicker of the start/stop button 12, the user readily realizes that it is possible to place a needle thread in a designated manner and pass the thread through the eye of the needle 6 and, furthermore, set a work cloth between the needle 6 and the needle plate and replace the shuttle bobbin while it is not possible to perform stitching.

In a case where the needle bar signal NS is at the low level, indicating that the needle bar 5 is out of the threading possible range (NO in step S15), that is, the needle 6 is below the needle plate or only slightly above the needle plate, or the needle 6 is substantially at the uppermost position, as can be seen from the diagram of FIG. 3, and where the presser foot 7 is at the pressing position (YES in step S27), the control unit 30 causes the start/stop button 12 to be illuminated with flickering green light, that is, a third illuminated state, in step 28, by flickering the green light-emitting diode and maintaining the non-driven state of the red light-emitting diode. Subsequently in step S19, the stitching permitting mode is set.

That is, the start/stop button 12 is illuminated with flickering green light when the needle bar 5 is out of the threading possible range, that is, the needle 6 is lower than the lower limit or substantially at the uppermost position, and the presser foot 7 is at the pressing position. Therefore, by the green flicker of the start/stop button 12, the user readily realizes that it is impossible to place a needle thread in the designated manner and pass the thread through the eye of the needle 6 and, furthermore, to set a work cloth between the needle 6 and the needle plate and replace the shuttle bobbin while it is possible to perform stitching.

If the needle bar 5 is out of the threading possible range, that is, mostly the needle 6 is lower than the lower limit, (NO in step S15) and the presser foot 7 is at the withdrawn upper position (NO in step S27), the control unit 30 causes the start/stop button 12 to be illuminated with steady red light, that is, a fourth illuminated state, in step S29, by driving the red light-emitting diode and maintaining the non-driven state of the green light-emitting diode. Subsequently in step S30, the stitching preventing mode is set.

That is, the start/stop button 12 is illuminated with steady red light when the needle bar 5 is out of the threading possible range, that is, the needle 6 is lower than the lower limit or substantially at the uppermost position, and the presser foot 7 is at the withdrawn position. Therefore, by the red illumination of the start/stop button 12, the user readily realizes that it is impossible to place a needle thread in the designated manner and pass the thread through the eye of the needle 6 and set a work cloth between the needle 6 and the needle plate and replace the shuttle bobbin and to perform stitching.

Figure 6:
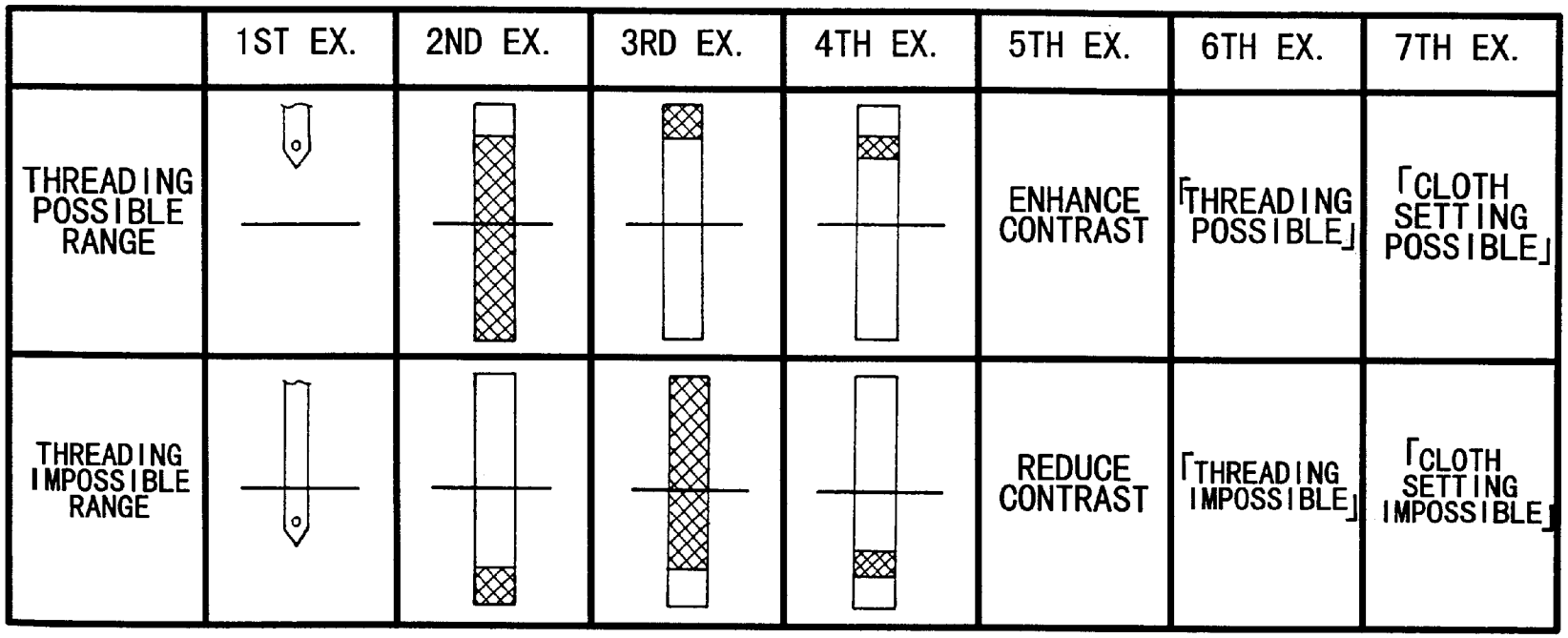
FIG. 6 illustrates display examples on a display screen, where different vertical positions of the needle bar are indicated.

The indication that the needle bar 5 is within the threading possible range and the indication that the needle bar 5 is out of the range, that is, threading is impossible, may also be provided in various manners on the liquid crystal display 13, for example, as shown in FIG. 6. The first display example indicates using the vertical position of the needle relative to the needle plate (above or below the needle plate) to represent the needle can be threaded (above the needle plate) or is in any position where it cannot be threaded (shown below the needle plate, but includes the eye of the needle physically below the needle plate, at or immediately above the needle plate and at the uppermost position). The second display example provides a similar display indicating the vertical position of the needle bar by the length of a lower dark portion in a vertical bar, the length being measured from the bottom. In a similar manner, the third display example indicates the vertical position of the needle bar by the length of an upper dark portion in a vertical bar, the length being measured from the top and the fourth display example indicates the vertical position of the needle bar by the vertical position of a dark fragment of a vertical bar.

Furthermore, as stated in the fifth display example in FIG. 6, the contrast in the first through fourth display examples may be changed for identification. It is also possible to display messages, such as THREADING POSSIBLE, THREADING IMPOSSIBLE as shown in the sixth display example, or to display messages, such as CLOTH SETTING POSSIBLE, CLOTH SETTING IMPOSSIBLE as shown in the seventh display example.

Instead of the state identifying indications as in the aforementioned first to fourth illuminated states, it is also possible to use various sound patterns of the buzzer 49 to indicate the corresponding states in an identifiable manner.

That is, for the first illuminated state, the buzzer 49 is kept off. For the second to fourth illuminated states, the buzzer 49 is caused to sound with constant intervals, or with alternating intervals, or in a continuous sound pattern, respectively. It is also possible to change the pitch of the buzzer sound for identifiable indications.

The needle bar sensor 41 and the input interface 31 and the CPU 32 form a detection device. The color LED device 48 and steps S15 through S18 and steps S27 through S29 in the above-described stitching control form an informing device. Step S19 in the stitching control forms a stitching permission device.

As described above, when the bobbin winding is possible, the fifth illuminated state is established, where the color LED device 48 produces orange light, so that the start/stop button 12, disposed at an easy-to-see position, is illuminated with orange light. Therefore, a user can easily realize that the bobbin winding state has been established. When the needle bar 5 is within the threading possible range and the presser foot 7 is at the pressing position, the first illuminated state is established, where the start/stop button 12 is illuminated with steady green light for easy identification. Therefore, the user can easily realize that it is possible to place a needle thread at the designated positions and pass the thread through the eye of the needle 6 and to perform stitching while it is impossible to set and remove a work cloth and to replace the shuttle bobbin.

When the needle bar 5 is within the threading possible range and the presser foot 7 is at the withdrawn position, the second illuminated state is established, where the start/stop button 12 is illuminated with red flicker. Therefore, the user can easily realize that it is possible to place a needle thread at the designated positions and pass the thread through the eye of the needle 6 and, further, set a work cloth between the presser foot 7 and the needle plate and replace the shuttle bobbin while it is impossible to perform stitching.

When the needle bar 5 is out of the threading possible range and the presser foot 7 is at the pressing position, the third illuminated state is established, where the start/stop button 12 is illuminated with green flicker. Therefore, the user can easily realize that it is possible to perform stitching while it is impossible to place a needle thread at the designated positions and pass the thread through the eye of the needle 6 and, further, set a work cloth between the presser foot 7 and the needle plate and replace the shuttle bobbin.

When the needle bar 5 is out of the threading possible range and the presser foot 7 is at the withdrawn position, the fourth illuminated state is established, where the start/stop button 12 is illuminated with steady red light. Therefore, the user can easily realize that it is impossible to place a needle thread at the designated positions and pass the thread through the eye of the needle 6 and, further, set a work cloth between the presser foot 7 and the needle plate and replace the shuttle bobbin and perform stitching.

Modifications of the foregoing embodiment will be described below.

(1) When the needle bar 5 is within the threading possible range, that is, during the first or second illuminated state, the illumination by the color LED device 48 may be increased. When the needle bar 5 is out of the threading possible range, that is, during the third or fourth illuminated state, the illumination by the color LED device 48 may be reduced.

(2) The position of the needle bar 5 may be detected in increased aspects, that is, not only the vertical position of the needle bar 5 but also the horizontal oscillation position of the needle bar 5.

(3) The cloth setting possible state may also be indicated in an identifiable manner, when the phase angle is within the range of about 290° to about 360° as indicated in FIG. 3.

(4) The color LED device 48 may also be disposed at an easy-to-see position adjacent to the start/stop button 12.

(5) The display control of the color LED device 48 in the stitching control according to the foregoing embodiment is merely illustrative, and may be modified in various ways without departing from the scope of the invention.

The electronically controlled sewing machine of the invention includes a detection device and an informing device as described above, so that based on the indication provided by the informing device, a user can easily identify whether the needle is within a predetermined position range above the needle plate.

In the embodiment of the invention, the predetermined position range of the needle is a range in which at least one of needle threading, work cloth setting, and bobbin replacement is possible. Therefore, even if the predetermined position range of the needle is narrow, the needle bar can be precisely positioned by manually moving the needle bar so that the informing device informs, or indicates to, the user that the needle is within the predetermined position range, in a manner specific to the situation. By shifting the needle bar in position in this manner, it becomes possible to perform at least one of the needle threading, the work cloth setting and the bobbin replacement without fail.

In the embodiment, the informing device uses a plurality of light-emitting diodes that emit different color lights for identifiable indications. Therefore, based on the color illuminations by the light-emitting diodes, the user can easily identify whether the needle or needle bar is within the predetermined position range.

In the embodiment, the informing device is incorporated into the switch button for operating the stitching start switch that outputs a stitching start instruction. Because the switch button for operating the stitching start switch is disposed at such a position that the button is easy to operate and easy to see, the informing device can effectively inform the operator of the position of the needle, via the switch button.

Furthermore, the informing device may be provided near the switch button for operating the stitching start switch that outputs a stitching start instruction. Because the switch button for operating the stitching is disposed at such a position that the button is easy to operate and easy to see, the informing device, disposed near the switch button, can effectively inform the user of the position of the needle.

Further, the informing device may change at least one of a sound length and a sound pitch for identifiable indications. Therefore, based on the sound indication, the user can easily identify whether the needle or needle bar is within the predetermined position range.

The electronically controlled sewing machine of the invention may further include a stitching permitting device that cooperates with the informing device and permits stitching to be started if stitching is possible. Therefore, the stitching operation becomes possible only if the needle or the needle bar is within the predetermined position range and thread placement, needle threading, and replacement of a bobbin have been performed. Thus, the ease of operation, particularly, for an inexperienced user, is improved.

It is to be understood that the invention is not restricted to the particular forms shown in the foregoing embodiment. Various modifications and alternations can be made thereto without departing from the scope of the invention.

What is claimed is:

1. A sewing machine, comprising:

a machine body;

a needle bar holding a needle at a lower end portion of the needle bar;

a needle bar drive mechanism mounted in the machine body that drives the needle bar at least in up-down directions;

a detection device that detects a position of the needle bar; and an informing device that receives a detection signal from the detection device and informs a user, with at least one of identifiable indications of color of light, length of sound, and pitch of sound whether the position of the needle is within a predetermined position range above a needle plate.

2. The sewing machine according to claim 1, wherein the predetermined position range of the needle is a range in which at least one of needle threading, work cloth setting, and bobbin replacement is possible.

3. The sewing machine according to claim 1, wherein the informing device uses a plurality of light-emitting diodes that emit different color lights for identifiable indications.

4. The sewing machine according to claim 1, wherein the informing device is incorporated into a switch button for operating a stitching start switch that outputs a stitching start instruction.

5. The sewing machine according to claim 1, wherein the informing device is provided near a switch button for operating a stitching start switch that outputs a stitching start instruction.

6. The sewing machine according to claim 1, further comprising a stitching permitting device that cooperates with the informing device and permits stitching to be started if stitching is possible.

7. The sewing machine according to claim 1, further comprising a display indicating patterns of sewing.

8. The sewing machine according to claim 1, wherein the informing device informs the user whether the position of the needle is within a predetermined position range above a needle plate when the sewing machine is in condition of useable for sewing.

9. The sewing machine according to claim 1, further comprising:

a movable presser foot that retains a cloth at a sewing position on the machine body; and a further detection device that detects a lowered position or a predetermined withdrawn position of the presser foot, the detection device and further detection device comprising a sensor system, wherein the needle bar drive mechanism is a drive motor and the informing device comprises:

a notification system that informs a user of an operational state of the sewing machine; and a control system for controlling the notification system to inform the user of the operational state of the sewing machine.

10. The sewing machine according to claim 9, further comprising a bobbin winding mechanism, wherein another detecting device comprises a sensor that detects a position of the bobbin winding mechanism.

11. The sewing machine according to claim 10, wherein the informing device comprises at least one of a light display, a display screen, and an aural output.

12. The sewing machine according to claim 4, wherein the light display is incorporated into a start/stop switch on the machine body and includes at least two different color light emitting elements.

13. The sewing machine according to claim 11, wherein the light display is mounted on the machine body adjacent a start/stop switch and includes at least two different color light emitting elements.

14. The sewing machine according to claim 11, wherein the display screen displays a graphic representation of at least the needle bar position.

15. The sewing machine according to claim 12, wherein the aural output further comprises, in addition to at least one of length of sound and pitch of sound, at least one of a different volume of sound, and different number of repetitions of sound to indicate the operational state.

16. The sewing machine according to claim 12, wherein the two different color light emitting elements comprise a green light emitting diode and a red light emitting diode.

17. The sewing machine according to claim 13, wherein the two different color light emitting elements comprise a green light emitting diode and a red light emitting diode.

18. The sewing machine according to claim 9, wherein the notification system notifies the user of at least five operational states.

19. A sewing machine, comprising:

a machine body;

a drive motor mounted in the machine body;

a needle bar mounting a sewing needle driven by the drive motor;

a movable presser foot that retains a cloth at a sewing position on the machine body;

a bobbin winding mechanism on the machine body;

a sensor system that detects a position of the needle bar, a position of the presser foot, and a position of the bobbin winding mechanism;

a notification system that informs a user of an operational state of the sewing machine;

a control system that controls the notification system to inform the user of the operational state of the sewing machine, wherein the sensor system comprises:

a first sensor that detects the position of the needle bar;

a second sensor that detects the position of the presser foot; and a third sensor for detecting the position of the bobbin winding mechanism, and wherein the notification system is one of a light display incorporated into a start/stop switch on the machine body and a light display mounted on the machine body adjacent a start/stop switch, the light display including, in either location, at least two different color light emitting elements.

20. The sewing machine according to claim 1, further comprising a movable presser foot that retains a cloth at a sewing position on the machine body, wherein the further detection device detects a position of the presser foot, the informing device informs a user of a first operational state with a first manner, a second operational state with a second manner, a third operational state with a third manner and a fourth operational state with a fourth manner respectively, based on the detected position of both the needle bar and the presser foot.

21. The sewing machine according to claim 20, wherein the first operational state is an operational state in which both needle threading and stitching are permitted, the second operational state is an operational state in which needle threading is permitted and stitching is prohibited, the third operational state is an operational state in which needle threading is prohibited and stitching is permitted, and the fourth operational state is an operational state in which both needle threading and stitching are prohibited.

22. The sewing machine according to claim 20, further comprising a bobbin winding mechanism on the machine body, wherein the sensor system further detects a position of the bobbin winding mechanism, the informing device further informs a user of a fifth operational state with a fifth manner, the fifth operational state is a bobbin winding state.

* * * * *